US005562208A

United States Patent [19]

Hasler et al.

[11] Patent Number: 5,562,208

[45] Date of Patent: Oct. 8, 1996

[54] TOOL BIT STORAGE CASE

[75] Inventors: Theodore J. Hasler, Chicago; James G. Hansen, Winnetka, both of Ill.; John B. King, III, New Freedom, Pa.

[73] Assignee: Black & Decker Inc., Newark, Del.

[21] Appl. No.: 520,195

[22] Filed: Aug. 28, 1995

Related U.S. Application Data

[63] Continuation of Ser. No. 281,811, Aug. 18, 1994, abandoned.

[51] Int. Cl.[6] ..... B65D 85/24

[52] U.S. Cl. ..... 206/373; 206/374; 206/472

[58] Field of Search ..... 206/379, 378, 206/377, 376, 373, 372, 472

[56] References Cited

U.S. PATENT DOCUMENTS

| | | | |
|---|---|---|---|
| D. 308,750 | 6/1990 | Hillinger . | |
| 479,180 | 7/1892 | Booth . | |
| 953,930 | 4/1910 | Stockinger . | |
| 979,981 | 12/1910 | Mike . | |
| 1,043,891 | 11/1912 | Zange . | |
| 2,205,969 | 6/1940 | Boenecke . | |
| 2,269,637 | 1/1942 | Polkosnik . | |
| 2,408,227 | 9/1946 | Ramsey . | |
| 2,736,426 | 2/1956 | Hamilton . | |
| 2,844,244 | 7/1958 | Hanson . | |
| 3,113,692 | 12/1963 | Pierro . | |
| 3,236,366 | 2/1966 | Broda et al. . | |
| 3,317,077 | 5/1967 | Braginetz et al. . | |
| 3,342,190 | 9/1967 | Hultgren et al. . | |
| 3,407,961 | 10/1968 | Box . | |
| 3,578,153 | 5/1971 | Olson . | |
| 3,610,460 | 10/1971 | Siklos et al. . | |
| 3,840,152 | 10/1974 | Hodge . | |
| 3,904,035 | 9/1975 | Metzler et al. . | |
| 3,923,152 | 12/1975 | Minneman . | |
| 3,978,984 | 9/1976 | Cowley . | |
| 4,032,008 | 6/1977 | Vecchiarelli . | |
| 4,190,929 | 3/1980 | Palka . | |
| 4,349,120 | 9/1982 | DiNardo . | |
| 4,358,871 | 11/1982 | Takai . | |
| 4,466,541 | 8/1984 | Tabler et al. . | |
| 4,467,947 | 8/1984 | Minneman . | |
| 4,512,467 | 4/1985 | Knoblauch . | |
| 4,561,543 | 12/1985 | Thompson . | |
| 4,598,822 | 7/1986 | Hemmings . | |
| 4,603,452 | 8/1986 | Paciorek . | |
| 4,880,122 | 11/1989 | Mastindell | 206/377 X |
| 4,930,753 | 6/1990 | Alvyn . | |
| 4,938,355 | 7/1990 | Rocco . | |
| 5,022,529 | 6/1991 | Kang . | |
| 5,033,634 | 7/1991 | Batchelor et al. . | |
| 5,048,715 | 9/1991 | Wolff . | |
| 5,125,523 | 6/1992 | Kulper . | |
| 5,127,132 | 7/1992 | Karlin . | |
| 5,148,914 | 9/1992 | Budert et al. . | |
| 5,172,810 | 12/1992 | Brewer . | |

(List continued on next page.)

OTHER PUBLICATIONS

"Allied" Tool Bit Storage Case (photograph).

Early Prototype shown during the development of the present invention (photographs).

*Primary Examiner*—Jacob K. Ackun

*Attorney, Agent, or Firm*—Harness, Dickey & Pierce, P.L.C.

[57] ABSTRACT

A tool bit storage case includes a front cover preferably hingedly interconnected with a back cover, with the covers being selectively separable and movable toward and away from each other between open and closed positions and together defining a generally hollow storage chamber therebetween. A removable pivotable tools bit holder is releasably retained within the hollow storage chamber on one of the covers and is adapted for holding one or more tool bits, with the tool bit holder being pivotal within the storage chamber in order to allow it to be selectively pivoted toward and away from the cover upon which it is retained when the covers are in the open position. The covers are also releasably snapped together, into and out of their preferred hinged interconnection, thus greatly contributing to the interchangeability of components to suit a wide variety of storage applications.

48 Claims, 5 Drawing Sheets

U.S. PATENT DOCUMENTS 5,186,339 2/1993 Heissler .
5,190,154 3/1993 Reusch .
5,203,469 4/1993 Chang et al. .
5,205,431 4/1993 Zinnbauer .
5,242,050 9/1993 Billings .
5,368,164 11/1994 Bennett et al. ..... 206/376 X
5,370,263 12/1994 Brown ..... 206/373 X

TOOL BIT STORAGE CASE

This is a continuation of U.S. patent application Ser. No. 08/281,811, filed Aug. 18, 1994 and now abandoned.

BACKGROUND AND SUMMARY OF THE INVENTION

The invention relates generally to storage cases for tool bits, including cutting tool bits such as drill bits, router bits or other workpiece forming bits, as well as fastener bits such as screwdriver bits, nut driver bits, and the like, and other such tool bit items. More particularly, the invention relates to tool bit storage cases having a clam-shell type of outer case with pivotally interconnected front and back covers and with a selectively removable tool bit holder housed and releasably retained between the front and back covers.

A wide variety of tool bit storage cases have been previously provided for storing and housing tool bits in order to keep them together in a handy, convenient place and to avoid misplacing one or more of such bits. A number of such previous tool bit storage cases have had hinged clam-shell configurations, inside of which the tool bits are housed and stored, with the front and back covers being pivotally interconnected between open and closed positions.

However, in many of such previous tool bit storage cases, the selection and removal of a particular tool bit from the plurality housed therein is frequently difficult or inconvenient without spilling out some or all of the remainder of the set of bits. Also, many of such previous storage cases require manufacturing the case components in a plurality of different non-interchangeable shapes or configurations in order to accommodate storage of different types or quantities of tool bits, thus adding significantly to the cost of the bit-and-case set. In addition, the performance of various work operations in which the tool bits are used frequently requires the use of various lay-out or measuring devices, linear, angular or diametric, in order to set up the work to be performed or to select the proper tool bit for performing the desired operation.

The present invention seeks to overcome these disadvantages or shortcomings, as well as others by providing a tool bit storage case assembly with the tool bit holder insert that is removably retained within the covers of an attractive user-friendly clam-shell case configuration and that takes advantage of interchangeability of various components. This contributes significantly to the cost-effectiveness and ease of manufacture of common case components for a wide variety of different tool bit storage applications, as well as providing for increased user ease and convenience. The invention accomplishes these objectives in large part by accommodating different tool bit holders that can be inserted into common case or cover components for the particular type of tool bits for which the case is intended. Additionally, even where different cover shapes or configurations are necessary, only one of the covers needs to be different in many instances, with such varying covers being usable with a variety of other interchangeable cover components.

Preferably, the present invention also provides linear, angular, and diametric indicia or lay-out tools incorporated into one or both of the covers, thus providing for greatly increased set-up speed and convenience for the user when performing a wide variety of work operations.

In accordance with preferred embodiments of the present invention, a tool bit storage case includes a front cover hingeally interconnected with a back cover, with the covers being pivotably movable toward and away from each other between open and closed positions, as well as being selectively separable from each other for user convenience and to accommodate component interchangeability. Each of the covers includes a generally hollow portion, together defining a generally hollow storage chamber therebetween when closed. One or more removable pivotable tool bit holders are releasably retained within the hollow storage chamber on one of the covers and are adapted for holding one or more tool bits, with the tool bit holder being pivotal within the storage chamber in order to allow it to be selectively pivoted toward and away from the cover upon which it is retained when the covers are in the open position. This feature greatly facilitates the ease of selection and removal of a particular tool bit from the plurality of tool bits stored therein, while maintaining the tool bits in an orderly stored condition when the covers are closed. This feature, along with the separable covers, allows a plurality of different tool bit holder and cover combinations to be used without unnecessary multiplicity of component configurations for widely varying storage applications.

Additional objects, advantages, and features of the present invention will become apparent from the following description of exemplary embodiments of the invention and the appended claims, taken in conjunction with the accompanying drawings.

DETAILED DESCRIPTION OF THE PREFERRED EMBODIMENTS

Figure 1:
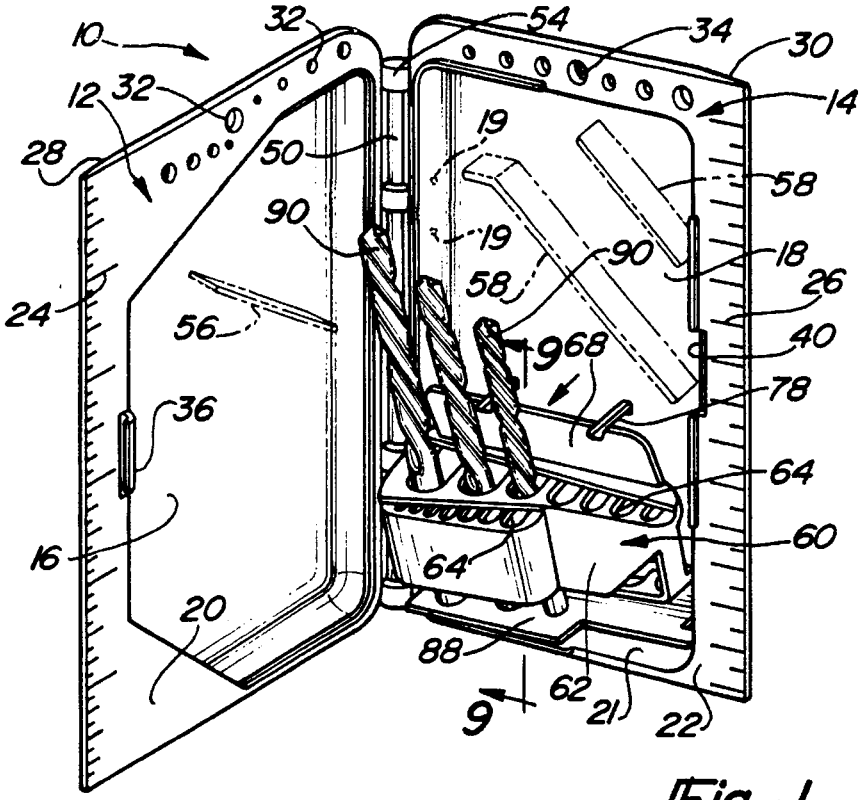
FIG. 1 is a perspective view of a tool bit storage case according to the present invention, shown in an open position in order to illustrate one exemplary embodiment of a tool bit holder therein.

FIGS. 1 through 19 illustrate various exemplary embodiments and features of tool bit storage cases according to the present invention. One skilled in the art will readily recognize, however, from the drawings and from the discussion below, that the principles of the present invention are equally applicable to tool bit storage cases other than those shown for purposes of illustration in the drawings, as well as tool bit storage cases adapted for storing tool bits of types other than those illustrated in the drawings.

In FIG. 1, a tool bit storage case 10 generally includes a front cover 12 preferably hingedly releasably interconnected with a back cover 14, with a tool bit holder 60 housed therebetween, although the covers 12 and 14 can also optionally be releasably interconnected in a non-pivotable or a non-hinged manner. In this regard, as will become apparent from the following discussion, a tool bit storage case according to the invention need not necessarily include two or more covers, optionally having instead only one cover or one other tray-like configuration.

In the exemplary embodiment of FIG. 1, the front and back covers 12 and 14 preferably include hollow portions 16 and 18, respectively, together defining a storage chamber therebetween for housing the tool bit holder 60 and one or more tool bits 90 therein. As is described in more detail below, the tool bit holder 60 is pivotally and releasably retained within one of the front or back covers 12 or 14, respectively, in order to allow for ease and convenience of removal of the tool bits 90, as well as facilitating the convenient removal and/or replacement of the tool bit holder 60 from within the front and back covers 12 and 14. Preferably the covers 12 and 14 pivot about a pivot axis that is different from, and transverse to, the pivot axis about which the tool bit holder 60 pivots. Either or both of the covers 12 and 14 can optionally include internal ribs 56 and 58, respectively, if deemed desirable to prevent the tool bits 90 from sliding out of the tool bit holder 60 when the covers 12 and 14 are closed.

Figure 2:
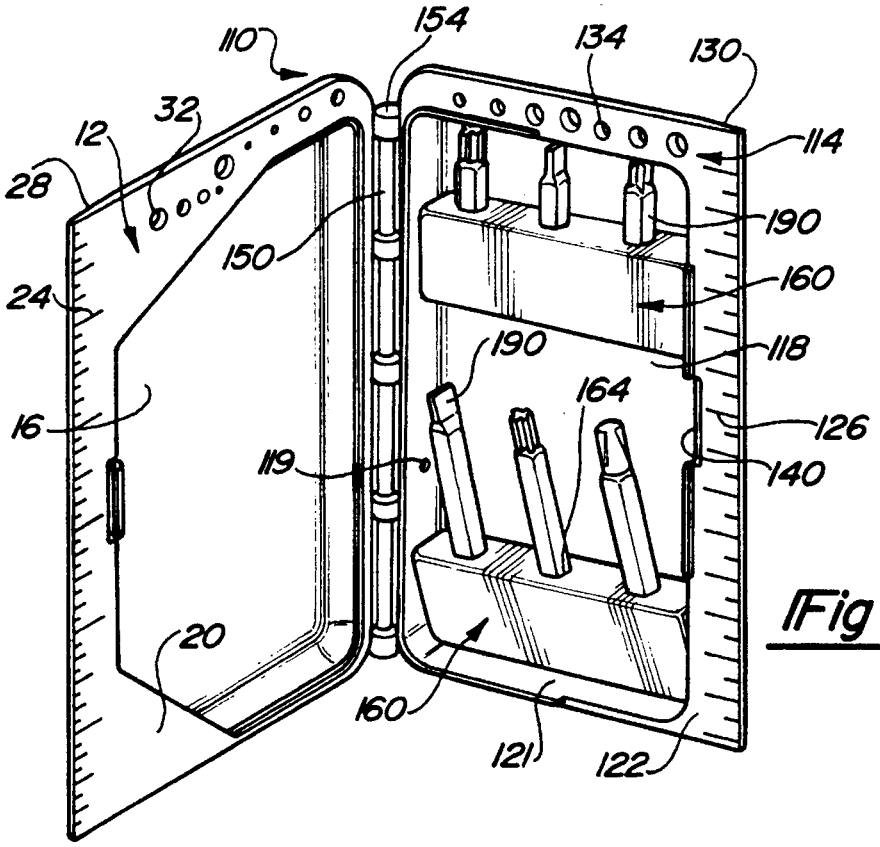
FIG. 2 is a perspective view similar to that of FIG. 1, but illustrating another exemplary embodiment of the present invention, wherein a different tool bit holder is housed within the tool bit storage case for housing a different type of tool bit set.
Figure 3:
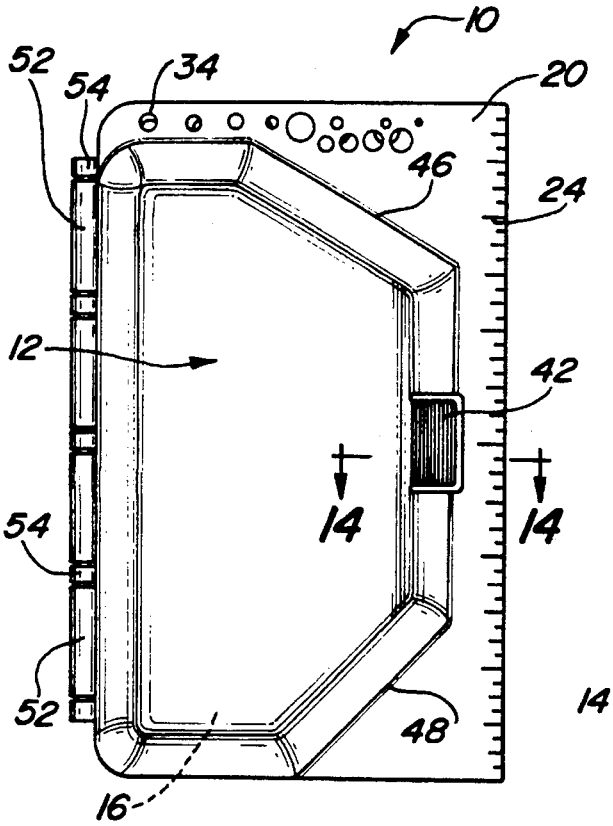
FIG. 3 is a front view of the tool bit storage case of FIG. 1.
Figure 4:
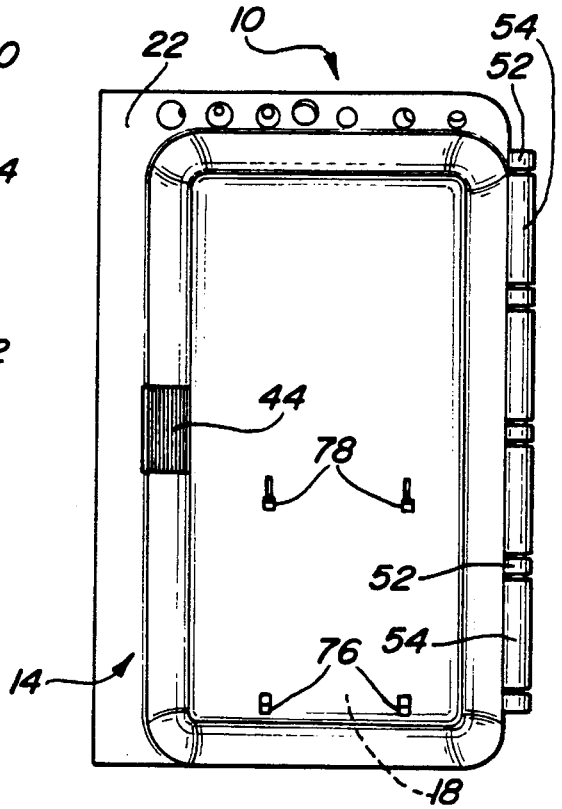
FIG. 4 is a rear view of the tool bit storage case of FIG. 1.
Figure 5:
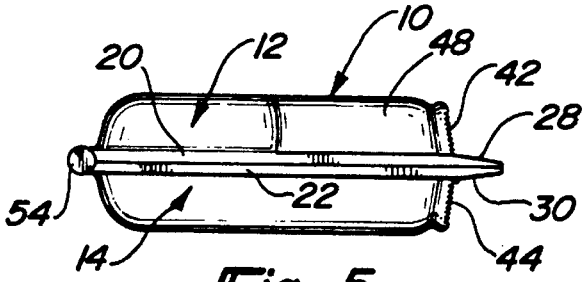
FIG. 5 is an end view of the tool bit storage case of FIG. 1.
Figure 6:
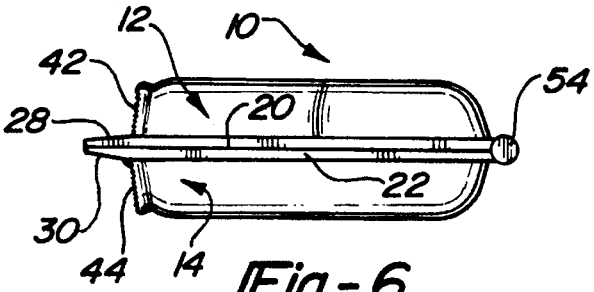
FIG. 6 is a view similar to that of FIG. 5, but illustrating the opposite end of the tool bit storage case.
Figure 7:
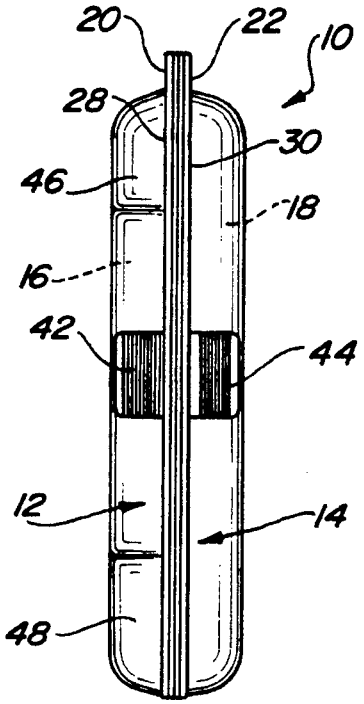
FIG. 7 is a side view of the tool bit storage case of FIG. 1.
Figure 8:
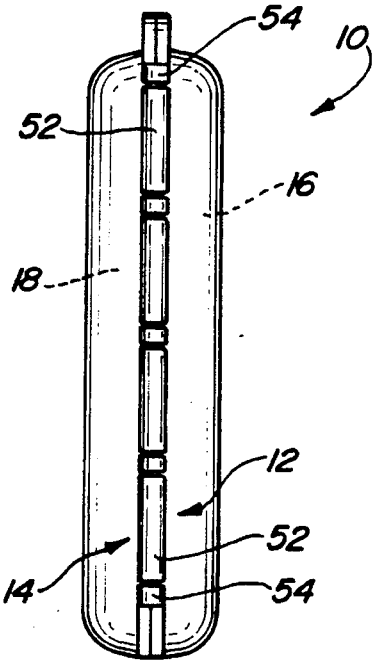
FIG. 8 is an opposite side view of the tool bit storage case of FIG. 1.

FIG. 2 illustrates an alternate, exemplary tool bit storage case 110, which is similar to the case 10 in FIG. 1, but which includes one or more alternate tool bit holders 160 for storing and housing a set of tool bits 190 that are different from those shown in FIG. 1. It should be noted that although FIG. 1 illustrates cutting tool bits 90 in the form of common twist drill bits, and FIG. 2 illustrates the tool bit holder 160 adapted for holding the screwdriver and other driver bits 190, the tool bit holders 60 and 160 can be adapted for holding and storing many other types of tool bits, and that other tool bit holders adapted for other specific storage applications (such as, for example, nut drivers or drivers adapted for other types of fasteners) can also be substituted for either of the tool bit holders 60 or 160, usually without changing the covers 12 and 14 or 114.

Referring primarily to FIGS. 1 through 6, the exemplary front and back covers 12 and 14 preferably include flange portions 20 and 22, respectively, extending along at least a portion of the periphery of the respective hollow portions 16 and 18. Such flange portions 20 and 22 are adapted to engage each other in a generally flat, face-to-face relationship when the covers 12 and 14 are in their closed position, as illustrated in FIGS. 3 through 6. In addition, in order to provide for increased convenience of the user, one or both of the flange portions 20 and 22 preferably include linear measuring indicia 24 and 26, respectively, on one or both sides thereof, with the measuring gradations being adapted for indicating English or metric measurements (or both), for example.

In embodiments where the above-mentioned linear measuring indicia are included on both sides of one or both of the flange portions 20 and 22, such measuring indicia can optionally be provided in increasing measuring distances, extending from zero to six inches, for example, in one direction on one side of one of the flanges, and extending from zero to six inches, for example, in the opposite direction on the opposite side of the same flange. Additionally, if desired, or even alternatively, one or one or more of the measuring indicia can be laid out for measuring in metric units on one set of measuring indicia and for measuring in English measuring units on another set of measuring indicia, again on opposite sides of one or both of the flanges 20 and 22. In this regard, the straight edge portions of the flanges 20 and 22 are preferably beveled along the edges 28 and 30, respectively, with the beveled edge portions decreasing in thickness toward the outer periphery of the flanges 20 and 22, in a radial direction with respect to the pivot axis of the hinge, thus providing for greater accuracy in measuring or in laying out work performance parameters.

In order to still further increase the convenience of the user, one or both of the flange portions 20 and 22 can include a number of diametric gauge openings 32 and 34, respectively, therein for purposes of aiding the user in the selection of the proper size of tool bit or fastener, for example.

In order to still further increase the convenience of the user, one or both of the hollow portions 16 and 18 of the front and back covers 12 and 14, respectively, are preferably provided with angularly-extending straight edge portions 46 and 48, respectively, at the intersection of the hollow cover portions 16 and 18 and the cover flanges 12 and 14, respectively. The angularly-extending straight edge portions 46 and 48 are preferably oriented at different commonly-used predetermined angles, such as 45°, 60°, or 30°. Such angularly-extending straight edge portions 46 and 48 of the hollow cover portions 16 and 18, respectively, allow them to be placed or indexed against the surface of a workpiece in order to correspondingly position the straight beveled edges 28 and 30 of the flange portions 20 and 22, respectively, at different commonly-used predetermined angles relative to the surface of the workpiece. Thus, the user enjoys the convenience of using the preferred tool bit storage case 10 as a triangle or protractor for laying out desired angles for measuring or cutting the workpiece, without the need for additional lay-out tools.

Referring primarily to FIG. 1 and FIGS. 9 through 12, a preferred tool bit holder 60 includes a body 62 having one or more openings 64 therein. Such openings 64 are adapted to receive the tool bits being stored within the tool bit storage case 10, and are preferably elongated in a direction toward and away from the cover upon which the tool bit holder 60 is retained, thus allowing the tool bits to be tipped toward and away from the cover for purposes of easy and convenient removal of a selected tool bit.

The body 62 of the tool bit holder 60 also preferably includes one or more openings 66, through which channel-shaped pivots 76 on the cover 14 can be received as the tool bit holder 60 is installed in place, with the channel-shaped pivots 76 capturing the tool bit holder 60 and allowing it to be pivoted toward and away from the cover. This feature, along with the above-mentioned elongated opening 64, greatly facilitates the ease and convenience of selecting, removing, and replacing a particular desired tool bit by allowing both the tool bit holder 60 and the tool bits themselves to be tipped or pivoted toward and away from the user. In addition, in order to releasably retain the tool bit holder 60 in its pivotal relationship with the associated cover 14, as shown in FIGS. 9 through 12, the cover 14 preferably includes a resilient retaining finger 78 protruding inwardly therefrom into the storage chamber. The retaining finger 78 includes a hooked free end portion 80, having oppositely-facing angled cam or ramp surfaces 80 and 82 thereon. Thus, as is shown in detail in FIGS. 11 and 12, the tool bit holder 60 can be easily and conveniently snapped into and out of its retained position on the cover (cover 14 in the illustrative embodiments) by way of resilient engagement with a flange portion 68 on the body 62 of the tool bit holder 60 with the angled ramp surfaces 82 and 84, respectively, of the resilient retaining finger 78. The tool bit holder 60 also preferably includes a tab portion 88 that is engageable by the user's thumb or finger in order to easily pivot the tool bit holder 60 toward and away from him or her.

Figure 9:
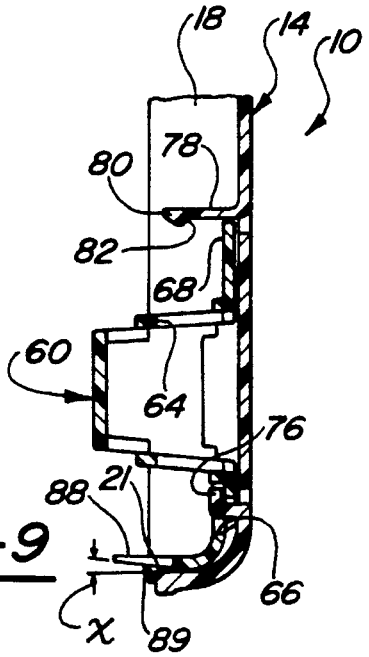
FIG. 9 is a partial cross-sectional view, taken generally along line 9—9 of FIG. 1, illustrating the tool bit holder and one of the covers of the tool bit storage case of FIG. 1, but with the tool bit holder shown in inwardly pivoted retained position.
Figure 10:
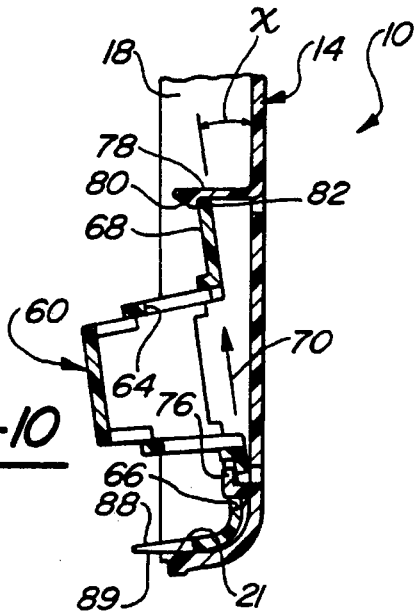
FIG. 10 is a partial, cross-sectional view similar to that of FIG. 9, but illustrating the tool bit holder in an outwardly pivoted retained position.
Figure 11:
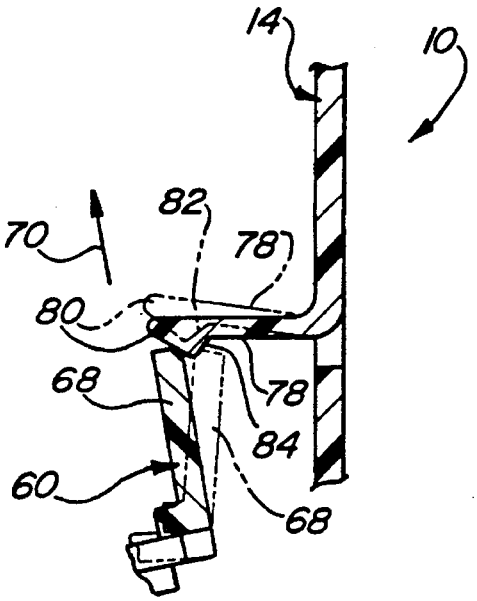
FIG. 11 is a partial, detailed cross-sectional view of a portion of the retaining structure for the tool bit holder of the tool bit storage case of FIG. 1, with a portion of the tool bit holder shown as it is being snapped into its retained position.
Figure 12:
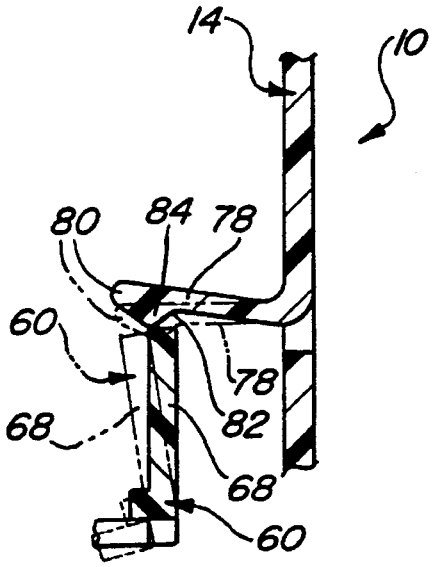
FIG. 12 is a partial, detailed cross-sectional view similar to that of FIG. 11, but illustrating the tool bit holder being snapped out of its retained position.
Figure 15:
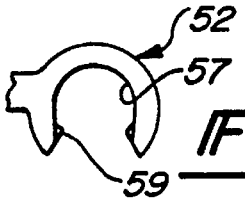
FIG. 15 is a partial, cross-sectional view, taken generally along line 15—15 of FIG. 13.
Figure 16:
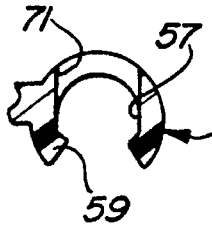
FIG. 16 is a partial, cross-sectional view, taken generally along line 16—16 of FIG. 13.

In this regard, it should be noted, with reference to FIGS. 9 and 10, that the tab portion 88 preferably has a beveled lower surface 89. When the tool bit holder 60 is pivoted back against the inside of the cover 14, the beveled surface 89 forms an angle x with the lower surface 21 of the inside of the hollow portion 18, as shown in FIG. 9. Likewise, when the tool bit holder 60 is pivoted outwardly, away from the inside of the cover 14, to its maximum outward position before resiliently deflecting the resilient fingers 78, the flange 68 forms the same angle x, as shown in FIG. 10, with the inside of the hollow portion 18. This is because the tab 88 has also pivoted to a position where its beveled surface 89 is pivotally "bottomed out", flatly engaging the lower surface 21 of the inside of the hollow portion 18. If the user wishes to remove the tool bit holder 60, he or she simply pushes the tab 88 inwardly to cause the flange 68 to snap outwardly free of the resilient fingers 78. The tab 88 in turn pushes against the lower surface 21 and urges the tool bit holder 60 in a generally upward and outward direction (such as indicated by arrow 70 in FIGS. 10 and 11), thereby lifting the tool bit holder 60 generally free of engagement between the pivot channel 76 and the edges of the openings 66. This allows the user to easily and conveniently lift the tool bit holder 60 completely free of the cover 14. The beveled lower surface 89 on the tab 88 functions in reverse, when the tool bit holder 60 is snapped back into its storage retention engagement with the resilient fingers 78, by guiding the tool bit holder downwardly into a position where tile pivot channels 76 re-engage the edges of the openings 66.

Figure 13:
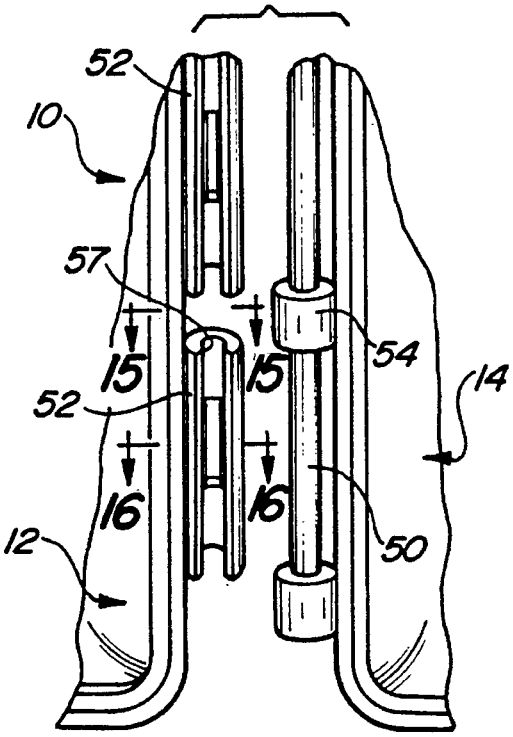
FIG. 13 is a partial, detailed view of the hinge structure for pivotally interconnecting the covers of the tool bit storage case of FIG. 1.

Referring primarily to FIG. 13, the front and back covers 12 and 14 of the preferred tool bit storage case 10 are hingedly interconnected by way of an elongated hinge pin 50, one or more hinge pin sockets 52, and one or more hinge pin sockets 54 offset longitudinally relative to the sockets 52. The hinge pin sockets 54 on the exemplary back cover 14 are preferably integrally formed with the hinge pin 50 but can be formed separately and inserted therethrough to retain the pin 50 in its proper position. The hinge pin sockets 52, however, only partially enclose their hinge pin openings or slots 57, with the slots 57 having detent protrusions 59 in the intermediate areas, circumferentially surrounding more than half, but less than all, of the hinge pin openings or slots 57 and of the diameter of the hinge pin 50. The hinge pin sockets 52 are resilient, allowing the cover 12 to be conveniently snapped laterally into or out of engagement with the hinge pin 50, by way of the engagement of the protrusions 59 with the hinge pin 50, thus allowing the covers 12 and 14 to be easily separated or attached. In this regard, the sockets 52 preferably include open portions 71 adjacent the protrusions 59, so as to facilitate removal of a movable portion of a mold in order to form the protrusions 59 during molding.

In order to increase the economy and cost-effectiveness of manufacturing the preferred tool bit storage case 10, a wide variety of different front and back covers 12 and 14, respectively, can be hingedly assembled and interconnected with each other, either during or after manufacture, in order to suit a wide variety of different tool bit storage applications. It should be noted that although the hinge pin sockets 52 are illustrated as being provided on the front cover 12 and the pin 50 and the hinge pin sockets 54 are illustrated as being provided on the back cover 14, the placement of these two different hinge pin sockets on the covers 12 and 14 can be reversed if desired in a particular application. Furthermore, as shown in FIG. 1, in order to increase the degree of component interchangeability, the back cover 14 can optionally also include a series of openings 19 on opposite sides of the hollow interior portion 18, similar to those of the back cover 114 shown in FIGS. 2 and 17 (discussed below). In such an optional, alternate embodiment, the resilient fingers 78, and possibly the pivot channels 76, could be molded so as to be frangibly broken off of the cover 14, thus allowing the cover 14 to be adaptable to the configuration of the cover 114 of FIG. 2, for purposes of allowing a single back or rear cover to be manufactured and used for even a wider variety of storage applications. It is preferred, however, that the rear covers 14 and 114 be molded as separate and distinct components.

Figure 14:
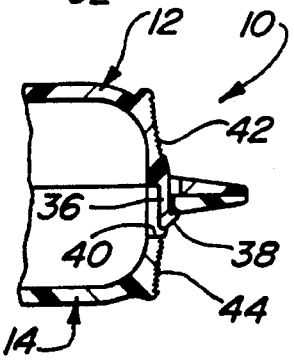
FIG. 14 is a partial cross-sectional view, taken generally along line 14—14 of FIG. 3, illustrating the latch mechanism for releasably securing the covers of the tool bit storage case of FIG. 1 to each other in a closed position.

Referring to FIG. 14, the covers 12 and 14 are preferably releasably held and retained in their closed position by way of a resilient latch finger 36 having a catch protuberance 38 thereon, with the resiliently deflectable latch finger 36 on the front cover 12 being received within a latch opening 40 formed in the back cover 14 when the covers are closed. Thus, when the covers 12 and 14 are hingedly pivoted to their closed position, the resilient latch finger 36 deflects to allow the catch 38 to pass latch opening 40, with the catch 38 then engaging a portion of the back cover 14 in order to releasably latch the covers 12 and 14 to each other. In order to provide ease of opening the preferred tool bit storage case 10, gripping surfaces 42 and 44 are provided on the front and back covers 12 and 14, respectively, generally adjacent the latch finger 36 and the latch opening 40, with the gripping surfaces 42 and 44 having ridges, knurling, or other surface discontinuities that provide adequate friction for the user's fingers during opening and closing of the covers 12 and 14.

Finally, as is illustrated in FIG. 1, and as is mentioned above, the front and back covers 12 and 14 can also optionally include one or more internal ribs 56 and 58, respectively, (shown in phantom lines) positioned on the inside of the hollow portions 16 and 18 of one or both of the covers 12 and 14. Such ribs 56 and 58 can serve to reinforce the covers and can be employed to prevent or at least substantially minimize any tendency of the tool bits 90 (or 190) to slide free of the elongated opening 64 when the front and back covers 12 and 14 are in their closed positions and the tool bit case is tipped or jostled.

Figure 17:
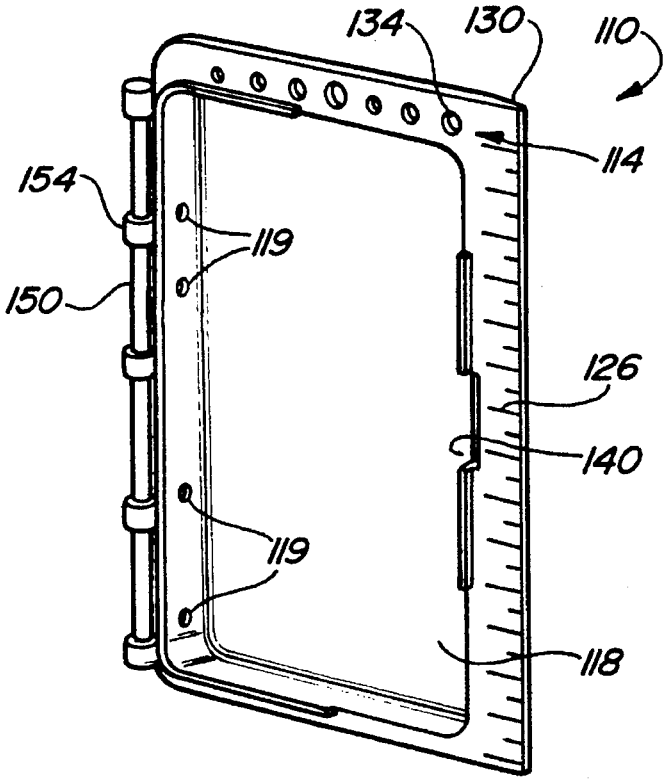
FIG. 17 is a perspective view of the back cover of the tool bit storage case of FIG. 2.
Figure 18:
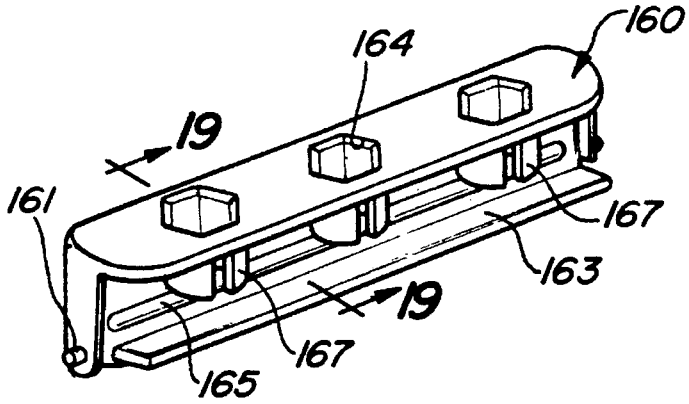
FIG. 18 is a perspective view of one of the tool bit holders of the tool bit storage case of FIG. 2.
Figure 19:
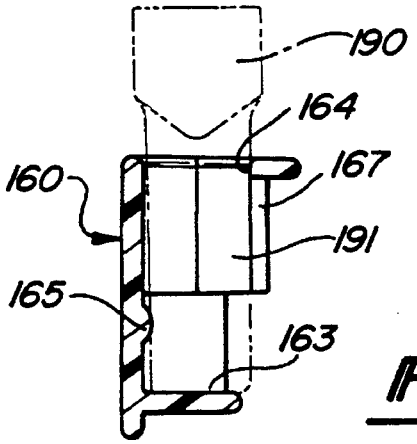
FIG. 19 is a partial, cross-sectional view, taken generally along line 19—19 of FIG. 18.

FIGS. 17 through 19 further illustrate the tool bit storage case 110 of FIG. 2, with its rear cover 114 and one or more tool bit holders 160 pivotally retained by the engagement of the preferably resilient pivot pins 161 with corresponding pairs of the openings 119 in opposite sides of the hollow portion 118 of the cover 114. Preferably, the cover 114 includes a series of opposite pairs of the openings 119, so as to accommodate different numbers and sizes of the tool bit holders 160 in order to suit the particular numbers and sizes of tool bits being stored in different storage applications. Also, because both the pivot pins 161 and the cover 114 are preferably composed of a resilient synthetic material (as are the remainders of the tool bit storage cases 10 and 110), the tool bit holder (or holders) 160 can preferably be resiliently snapped into and out of a releasable retention on the cover 114.

FIGS. 18 and 19 illustrate a preferred form of the tool bit holder 160, adapted for holding hex-shanked driver bits 190, for example. The exemplary tool bit holder 160 includes a number of hex-shaped openings or sockets 164, which are sized relative to the hex shanks 191 of the driver or tool bits 190 to appropriately slidingly grasp the shanks 191. This facilitates the user's ease in inserting or removing the tool bits 190 into or out of the hex openings 164. However, in order to keep the tool bits 190 from undesirably falling out of the slightly oversized hex openings 164, the tool bit holder 160 also includes a number of generally hollow, resilient split barrels or socket portions 167, each having one end adjacent one of the hex openings 164 and aligned therewith. The split barrels 167 partially surround the shanks 191 of the tool bits 190 when they are inside the hex openings 164. The tool bit holder 160 also includes a retaining rib 165 that protrudes slightly into the space below the opposite end of the resilient split barrels 167. Thus, when the tool bits 190 are inserted into the hex openings 164 and into the interiors of the split barrels 167, the hex shanks 191 are engaged and deflected slightly by the retaining rib 165 (as shown in phantom lines in FIG. 19) to urge them against the resiliently yieldable split barrels 167 such that the split barrels resiliently bias the hex shanks 191 against the retaining rib 165. This releasably and frictionally retains the tool bits 190 within the hex openings 164 and within the split barrels 167 to prevent them from falling loose inside the tool bit storage case 110, while still allowing them to be easily inserted or removed by the user into and out of, respectively, the tool bit holder 160.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A tool bit storage case, comprising: a cover having a generally hollow portion defining a generally hollow storage area therein, said case including a tool bit holder for removably holding at least one tool bit, said tool bit holder being pivotably interconnected within said storage chamber with said cover in order to allow said tool bit holder to be selectively pivoted toward and away from said cover about a pivot axis extending laterally across said cover, said cover having a selectively releasable retainer thereon including an elongated retaining finger which is resiliently deflectable for releasably retaining said tool bit holder thereon for limited pivotable movement within said storage chamber and for selectively permitting removal of said tool bit holder therefrom when said tool bit holder is pivoted away from said cover, said cover including a cover flange portion thereon extending along a portion of the periphery of said hollow portion.

2. A tool bit storage case according to claim 1, wherein said cover flange portion has linear measuring indicia thereon.

3. A tool bit storage case according to claim 2, wherein said cover flange portion with said linear measuring indicia thereon has a beveled edge thereon, tapering from a thicker area thereof to a thinner area thereof in a direction away from said hollow portion.

4. A tool bit storage case according to claim 1, wherein said cover flange has a plurality of diameter gauge openings therein.

5. A tool bit storage case according to claim 1, wherein said hollow portion of said cover has a straight edge portion extending in a direction transverse to a straight edge portion of said cover flange of said cover, said straight edge portion of said hollow portion being engageable with a surface of a workpiece in order to position said straight edge portion of said cover flange at a predetermined angle relative to said surface of said workpiece.

6. A tool bit storage case according to claim 1, wherein said tool bit holder includes at least one tool bit opening therein for removably receiving a tool bit inserted therein, said tool bit opening being elongated in a direction toward and away from said cover in order to allow the tool bit to be tipped toward and away from said cover when inserted into said elongated tool bit opening.

7. A tool bit storage case according to claim 1, wherein said tool bit holder includes at least one tool bit opening therein, a generally hollow resilient split barrel portion having an end generally aligned with and adjacent said tool bit opening, an end portion of said tool bit being receivable within said tool bit opening and said resilient split barrel portion, and a retaining rib adjacent an opposite end of said split barrel portion for engaging and deflecting said tool bit end portion against said split barrel portion when said tool bit end portion is inserted into said tool bit opening and said split barrel portion, said split barrel portion resiliently engaging said inserted tool bit end portion to resiliently bias said tool bit end portion toward said retaining rib, thus frictionally but releasably retaining said tool bit within said tool bit opening and said split barrel portion.

8. A tool bit storage case according to claim 7, wherein said tool bit opening is sized and configured to releasably engage said tool bit end portion in order to allow said tool bit end to be easily inserted into said tool bit opening and said split barrel portion.

9. A tool bit storage case according to claim 8, wherein said tool bit end portion is generally hex-shaped, and said tool bit opening is correspondingly hex-shaped.

10. A tool bit storage case according to claim 1, wherein said case further comprises another cover movable toward and away from said first-mentioned cover, and a hinge hingedly interconnecting said covers, said hinge including an elongated hinge pin, a first socket on one of said covers fully enclosing said hinge pin, and a second socket on the other of said covers having a partially-enclosed hinge pin opening therethrough, said second socket being longitudinally offset relative to said first socket and having a portion thereof surrounding more than half, but less than all, of the periphery of said partially-enclosed hinge pin opening, said second socket being resiliently deflectable to allow said hinge pin to be resiliently and laterally snapped into said partially-enclosed hinge pin opening in order to hingedly interconnect said covers with each other.

11. A tool bit storage case according to claim 1, wherein said case further comprises another cover hingedly interconnected with said first-mentioned cover, and a latch releasably latching said covers to each other when said covers are in a closed position, said latch including a resiliently deflectable latch member on a first of said covers, and a latch opening on a second of said covers for receiving said latch member therein when said covers are in said closed position, said latch member including a catch protuberance thereon for releasably engaging said second of said covers when received in said latch opening in order to releasably latch said covers to each other when said covers are in said closed position.

12. A tool bit storage case according to claim 11, wherein at least one of said covers includes a grip surface thereon, said grip surface being generally adjacent said latch in order to facilitate relative movement of said covers away from each other from said closed position to an open position.

13. A tool bit storage case, comprising: a cover having a generally hollow portion defining a generally hollow storage area therein, said case including a tool bit holder for removably holding at least one tool bit, said tool bit holder being pivotably interconnected within said storage area of said cover in order to allow said tool bit holder to be selectively pivoted toward and away from said cover about a pivot axis extending laterally across said cover, said cover having a selectively releasable retainer thereon for releasably retaining said tool bit holder thereon for limited pivotable movement within said storage area and for selectively permitting removal of said tool bit holder therefrom when said tool bit holder is pivoted away from said cover, said tool bit holder further including at least one tool bit opening therein, a generally hollow resilient split barrel portion having an end generally aligned with and adjacent said tool bit opening, an end portion of said tool bit being receivable within said tool bit opening and said resilient split barrel portion, and a retaining rib adjacent an opposite end of said split barrel portion for engaging and deflecting said tool bit end portion against said split barrel portion when said tool bit end portion is inserted into said tool bit opening and said split barrel portion, said split barrel portion resiliently engaging said inserted tool bit end portion to resiliently bias said tool bit end portion toward said retaining rib, thus frictionally but releasably retaining said tool bit within said tool bit opening and said split barrel portion, said tool bit opening being sized and configured to releasably engage said tool bit end portion in order to allow said tool bit end to be easily inserted into said tool bit opening and said split barrel portion.

14. A tool bit storage case according to claim 13, wherein said cover includes a cover flange portion thereon extending along a portion of the periphery of said hollow portions, said hollow portion of said cover having a straight edge portion extending in a direction transverse to a straight edge portion of said cover flange of said cover, said straight edge portion of said hollow portion being engageable with a surface of a workpiece in order to position said straight edge portion of said cover flange at a predetermined angle relative to said surface of said workpiece.

15. A tool bit storage case according to claim 14, wherein said cover flange portion has linear measuring indicia thereon.

16. A tool bit storage case according to claim 15, wherein said cover flange portion with said linear measuring indicia thereon has a beveled edge thereon, tapering from a thicker area thereof to a thinner area thereof in a direction away from said hollow portion.

17. A tool bit storage case according to claim 14, wherein said cover flange has a plurality of diameter gauge openings therein.

18. A tool bit storage case according to claim 13, wherein said case further comprises another cover hingedly interconnected with said first-mentioned cover, and a latch releasably latching said covers to each other when said covers are in a closed position, said latch including a resiliently deflectable latch member on a first of said covers, and a latch opening on a second of said covers for receiving said latch member therein when said covers are in said closed position, said latch member including a catch protuberance thereon for releasably engaging said second of said covers when received in said latch opening in order to releasably latch said covers to each other when said covers are in said closed position.

19. A tool bit storage case according to claim 18, wherein at least one of said covers includes a grip surface thereon, said grip surface being generally adjacent said latch in order to facilitate relative movement of said covers away from each other from said closed position to an open position.

20. A tool bit storage case, comprising a cover having a generally hollow portion defining a generally hollow storage area therein, said case including a tool bit holder for removably holding at least one tool bit, said tool bit holder being pivotably interconnected within said storage area of said cover in order to allow said tool bit holder to be selectively pivoted toward and away from said cover about a pivot axis extending laterally across said cover, said cover having a selectively releasable retainer thereon for releasably capturing a first portion of said tool bit holder in order to releasably retain said tool bit holder thereon for limited pivotable movement within said storage area and for selectively permitting removal of said tool bit holder therefrom when said tool bit holder is pivoted away from said cover, said retainer including an elongated retaining finger on said cover for releasably capturing a second portion of said tool bit holder, said retaining finger being resiliently deflectable in order to allow said tool bit holder to be selectively retained on said cover in said limited pivotably movable relationship therewith and to be selectively released and removed therefrom.

21. A tool bit storage case according to claim 20, wherein said tool bit holder further includes a tab portion thereon protruding generally away from said cover, said tab portion being engageable by a user to pivot said tool bit holder toward and away from said cover.

22. A tool bit storage case according to claim 20, wherein said retaining finger protrudes from an inside portion of said cover and has a hook portion thereon engageable with said second portion of said tool bit holder, said hook portion having angled ramp portions on opposite sides thereof oriented generally toward and away from said cover in order to allow said tool bit holder to be selectively and resiliently snapped into and out of said retained relationship with said cover.

23. A tool bit storage case according to claim 20, wherein said retainer includes a generally channel-shaped structure on said cover for removably receiving said first portion of said tool bit holder therein in a pivotable relationship therewith.

24. A tool bit storage case according to claim 20, wherein said cover includes a cover flange portion thereon extending along a portion of the periphery of said hollow portions.

25. A tool bit storage case according to claim 24, wherein said cover flange portion has linear measuring indicia thereon.

26. A tool bit storage case according to claim 25, wherein said cover flange portion with said linear measuring indicia thereon has a beveled edge thereon, tapering from a thicker area thereof to a thinner area thereof in a direction away from said hollow portion.

27. A tool bit storage case according to claim 24, wherein said cover flange has a plurality of diameter gauge openings therein.

28. A tool bit storage case according to claim 24, wherein said hollow portion of said cover has a straight edge portion extending in a direction transverse to a straight edge portion of said cover flange of said cover, said straight edge portion of said hollow portion being engageable with a surface of a workpiece in order to position said straight edge portion of said cover flange at a predetermined angle relative to said surface of said workpiece.

29. A tool bit storage case according to claim 20, wherein said tool bit holder includes at least one tool bit opening therein for removably receiving a tool bit inserted therein, said tool bit opening being elongated in a direction toward and away from said cover in order to allow the tool bit to be tipped toward and away from said cover when inserted into said elongated tool bit opening.

30. A tool bit storage case according to claim 20, wherein said case further comprises another cover movable toward and away from said first-mentioned cover, and a hinge hingedly interconnecting said covers, said hinge including an elongated hinge pin, a first socket on one of said covers fully enclosing said hinge pin, and a second socket on the other of said covers having a partially-enclosed hinge pin opening therethrough, said second socket being longitudinally offset relative to said first socket and having a portion thereof surrounding more than half, but less than all, of the periphery of said partially-enclosed hinge pin opening, said second socket being resiliently deflectable to allow said hinge pin to be resiliently and laterally snapped into said partially-enclosed hinge pin opening in order to hingedly interconnect said covers with each other.

31. A tool bit storage case according to claim 20, wherein said case further comprises another cover hingeally interconnected with said first-mentioned cover, and a latch releasably latching said covers to each other when said covers are in a closed position, said latch including a resiliently deflectable latch member on a first of said covers, and a latch opening on a second of said covers for receiving said latch member therein when said covers are in said closed position, said latch member including a catch protuberance thereon for releasably engaging said second of said covers when received in said latch opening in order to releasably latch said covers to each other when said covers are in said closed position.

32. A tool bit storage case according to claim 31, wherein at least one of said covers includes a grip surface thereon, said grip surface being generally adjacent said latch in order to facilitate relative movement of said covers away from each other from said closed position to an open position.

33. A tool bit storage case, comprising a cover having a generally hollow portion defining a generally hollow storage area therein, said case including a tool bit holder for removably holding at least one tool bit, said tool bit holder being pivotably interconnected within said storage area of said cover in order to allow said tool bit holder to be selectively pivoted toward and away from said cover about a pivot axis extending laterally across said cover, said cover having a selectively releasable retainer thereon for releasably capturing a first portion of said tool bit holder in order to releasably retain said tool bit holder thereon for limited pivotal movement within said storage area, said retainer including a generally channel-shaped member for removably receiving said first portion of said tool bit holder therein in a pivotable relationship therewith, and an elongated retaining finger on said cover for releasably capturing a second portion of said tool bit holder, said retaining finger being resiliently deflectable in order to allow said tool bit holder to be selectively retained on said cover in said limited pivotably movable relationship therewith and to be selectively released and removed therefrom, said retaining finger protruding from an inside portion of said cover and having a hook portion thereon engageable with said second portion of said tool bit holder, said hook portion having angled ramp portions on opposite sides thereof oriented generally toward and away from said cover in order to allow said tool bit holder to be selectively and resiliently snapped into and out of said retained relationship with said cover.

34. A tool bit storage case according to claim 33, wherein said tool bit holder further includes a tab portion thereon protruding generally away from said cover, said tab portion being engageable by a user to pivot said tool bit holder toward and away from said cover.

35. A tool bit storage case according to claim 33, wherein cover includes a cover flange portion thereon extending along a portion of the periphery of said hollow portion.

36. A tool bit storage case according to claim 35, wherein said cover flange portion has linear measuring indicia thereon.

37. A tool bit storage case according to claim 36, wherein said cover flange portion with said linear measuring indicia thereon has a beveled edge thereon, tapering from a thicker area thereof to a thinner area thereof in a direction away from said hollow portion.

38. A tool bit storage case according to claim 35, wherein said cover flange has a plurality of diameter gauge openings therein.

39. A tool bit storage case according to claim 35, wherein said hollow portion of said cover has a straight edge portion extending in a direction transverse to a straight edge portion of said cover flange of said cover, said straight edge portion of said hollow portion being engageable with a surface of a workpiece in order to position said straight edge portion of said cover flange at a predetermined angle relative to said surface of said workpiece.

40. A tool bit storage case according to claim 33, wherein said tool bit holder includes at least one tool bit opening therein for removably receiving a tool bit inserted therein, said tool bit opening being elongated in a direction toward and away from said cover in order to allow the tool bit to be tipped toward and away from said cover when inserted into said elongated tool bit opening.

41. A tool bit storage case according to claim 33, wherein said case further comprises another cover movable toward and away from said first-mentioned cover, and a hinge hingeally interconnecting said covers, said hinge including an elongated hinge pin, a first socket on one of said covers fully enclosing said hinge pin, and a second socket on the other of said covers having a partially-enclosed hinge pin opening therethrough, said second socket being longitudinally offset relative to said first socket and having a portion thereof surrounding more than half, but less than all, of the periphery of said partially-enclosed hinge pin opening, said second socket being resiliently deflectable to allow said hinge pin to be resiliently and laterally snapped into said partially-enclosed hinge pin opening in order to hingedly interconnect said covers with each other.

42. A tool bit storage case according to claim 33, wherein said case further comprises another cover hingedly interconnected with said first-mentioned cover, and a latch releasably latching said covers to each other when said covers are in said closed position, said latch including a resiliently deflectable latch member on a first of said covers, and a latch opening on a second of said covers for receiving said latch member therein when said covers are in said closed position, said latch member including a catch protuberance thereon for releasably engaging said second of said covers when received in said latch opening in order to releasably latch said covers to each other when said covers are in said closed position.

43. A tool bit storage case according to claim 42, wherein at least one of said covers includes a grip surface thereon, said grip surface being generally adjacent said latch in order to facilitate relative movement of said covers away from each other from said closed position to an open position.

44. A tool bit storage case, comprising a front cover hingedly interconnected with a back cover, said covers being pivotably movable toward and away from each other about a first pivot axis between a closed position and an open position, each of said covers having a generally hollow portion defining a generally hollow storage chamber therebetween, said case including a tool bit holder for removably holding at least one tool bit, said tool bit holder being pivotably interconnected within said storage chamber with one of said covers in order to allow said tool bit holder to be selectively pivoted toward and away from said one of said covers about a second pivot axis transverse to said first pivot axis when said covers are in said open position, said one of said covers having a selectively releasable retainer thereon for releasably capturing a first portion of said tool bit holder in order to releasably retain said tool bit holder thereon for limited pivotable movement within said storage chamber, said retainer including a generally channel-shaped member for removably receiving said first portion of said tool bit holder therein in a pivotable relationship therewith, and an elongated retaining finger on said one of said covers for releasably capturing a second portion of said tool bit holder, said retaining finger being resiliently deflectable in order to allow said tool bit holder to be selectively retained on said one of said covers in said limited pivotably movable relationship therewith and to be selectively released and removed therefrom, said retaining finger protruding from an inside portion of said one of said covers and having a hook portion thereon engageable with said second portion of said tool bit holder, said hook portion having angled ramp portions on opposite sides thereof oriented generally toward and away from said cover in order to allow said tool bit holder to be selectively and resiliently snapped into and out of said retained relationship with said cover, said tool bit storage case further comprising a hinge hingedly interconnecting said front and back covers, said hinge including an elongated hinge pin, a first socket on one of said covers fully enclosing said hinge pin, and a second socket on the other of said covers having a partially-enclosed hinge pin opening therethrough, said second socket being longitudinally offset relative to said first socket and having a portion thereof surrounding more than half, but less than all, of the periphery of said partially-enclosed hinge pin opening, said second socket being resiliently deflectable to allow said hinge pin to be resiliently and laterally snapped into said partially-enclosed hinge pin opening in order to hingedly interconnect said covers with each other, each of said covers including a cover flange portion thereon extending along a portion of the periphery of said hollow portions, said cover flange portions engaging each other in a generally face-to-face relationship when said covers are in said closed position, at least one of said cover flange portions has linear measuring indicia thereon and a beveled edge tapering from a thicker area thereof to a thinner area thereof in a direction away from said hollow portion, at least one of said cover flanges has a plurality of diameter gauge openings therein, and said hollow portion of at least one of said covers having a straight edge portion extending in a direction transverse to a straight edge portion of said cover flange of said one of said covers, said straight edge portion of said hollow portion being engageable with a surface of a workpiece in order to position said straight edge portion of said cover flange at a predetermined angle relative to said surface of said workpiece.

45. A tool bit storage case according to claim 44, wherein said tool bit holder includes a tab portion thereon protruding generally away from said one of said covers, said tab portion being engageable by a user to pivot said tool bit holder toward and away from said one of said covers.

46. A tool bit storage case according to claim 44, wherein said tool bit holder includes at least one tool bit opening therein for removably receiving a tool bit inserted therein, said tool bit opening being elongated in a direction toward and away from said one of said covers in order to allow the tool bit to be tipped toward and away from said one of said covers when inserted into said elongated tool bit opening.

47. A tool bit storage case according to claim 44, including a latch releasably latching said covers to each other when said covers are in said closed position, said latch including a resiliently deflectable latch member on a first of said covers, and a latch opening on a second of said covers for receiving said latch member therein when said covers are in said closed position, said latch member including a catch protuberance thereon for releasably engaging said second of said covers when received in said latch opening in order to releasably latch said covers to each other when said covers are in said closed position.

48. A tool bit storage case according to claim 47, wherein at least one of said covers includes a grip surface thereon, said grip surface being generally adjacent said latch in order to facilitate relative movement of said covers away from each other from said closed position to an open position.

* * * * *